US008091750B2

(12) United States Patent
Chen

(10) Patent No.: US 8,091,750 B2
(45) Date of Patent: Jan. 10, 2012

(54) TAPE DISPENSER FOR TAPE ROLL

(75) Inventor: Yu-Gang Chen, Tainan County (TW)

(73) Assignee: Far East University, Tainan County (TW)

( * ) Notice: Subject to any disclaimer, the term of this patent is extended or adjusted under 35 U.S.C. 154(b) by 0 days.

(21) Appl. No.: 12/649,090

(22) Filed: Dec. 29, 2009

(65) Prior Publication Data

US 2010/0096427 A1 Apr. 22, 2010

Related U.S. Application Data

(63) Continuation-in-part of application No. 11/340,440, filed on Jan. 27, 2006, now abandoned.

(51) Int. Cl.
*B65H 35/00* (2006.01)

(52) U.S. Cl. ..... 225/39; 225/56; 225/91; 242/588.3

(58) Field of Classification Search ..... 225/93, 225/57, 58, 65, 66, 6, 7, 9, 10, 16, 15, 19, 225/20, 24–26, 28, 39, 56, 91; 156/576, 156/577; 242/588.6, 588.3, 422.5, 405, 579, 242/580

See application file for complete search history.

(56) References Cited

U.S. PATENT DOCUMENTS

| | | | | |
|---|---|---|---|---|
| 2,284,807 | A | 6/1942 | Donahoo et al. | |
| 2,528,958 | A * | 11/1950 | Loss | 225/26 |
| 2,734,575 | A | 2/1956 | Gilbreth et al. | |
| 3,904,095 | A | 9/1975 | Doyle | |
| 4,405,068 | A | 9/1983 | Blair | |
| 5,634,580 | A | 6/1997 | Levy | |
| 5,788,807 | A * | 8/1998 | Gratz | 156/577 |
| 2004/0069893 | A1 * | 4/2004 | Kroecher | 242/588 |
| 2007/0012743 | A1 * | 1/2007 | Yu Chen | 225/19 |

* cited by examiner

*Primary Examiner* — Phong Nguyen
(74) *Attorney, Agent, or Firm* — WPAT, P.C.; Anthony King

(57) ABSTRACT

A tape dispenser for a tape roll comprises a main seat, a rotation member, a dragging member, a cutting edge, a contact member and a supporting member. The main seat has a front member and two side members, the two side members thereof are structured with a Concave-shaped hollow space. The rotation member is connected to one side member of the main seat and move toward to the other side member of the main seat. The dragging member is mounted between the tops of the two side members of the main seat. The cutting edge locates transversally at the top of the front member of the main seat. The supporting member is located below the dragging member. A clearance space is formed between the dragging member and the supporting member. The aforementioned Concave-shaped hollow space makes users with their fingers to access the free end of the tape roll.

2 Claims, 3 Drawing Sheets

TAPE DISPENSER FOR TAPE ROLL

CROSS-REFERENCE TO RELATED APPLICATIONS

This application claims priority to, and is a Continuation-in-Part of, U.S. patent application Ser. No. 11/340,440, filed on Jan. 27, 2006, now pending, which claims priority from U.S. patent application Ser. No. 10/870,989, filed on Jun. 21, 2004, now abandoned, which are hereby incorporated by reference in their entirety.

Although incorporated by reference in its entirety, no arguments or disclaimers made in the parent application apply to this divisional application. Any disclaimer that may have occurred during the prosecution of the above-referenced application(s) is hereby expressly rescinded. Consequently, the Patent Office is asked to review the new set of claims in view of all of the prior art of record and any search that the Office deems appropriate.

BACKGROUND OF THE INVENTION

1. Field of the Invention

The present invention relates to a tape dispenser for a tape roll, and more particular to a convenient tape dispenser which is surrounding a tape roll and can move on the tape roll while dragging the tape.

2. Description of the Prior Art

U.S. Pat. No. 2,284,807 discloses a tape dispenser, wherein, during the process of operation, the tape dispenser remains stationary at its original position and the peeled-off tape cannot drag the tape dispenser to move with it; that is, there is no sufficient clearance preserved between the tape dispenser and the tape roll, such that it will not be very smooth in dragging the tape. Furthermore, after performing the cutting operation by the tape dispenser, there is no dragging end preserved for facilitating the next operation, which will not be convenient and will usually require some effort to find out the tape end for the next usage. U.S. Pat. No. 3,904,095 discloses another tape dispenser including two U-shape members being assembled and surrounding the tape roll, wherein the cutting edge is facing the tape, such that the peeled-off tape cannot drag the tape dispenser to move with it, either. In addition, after performing the cutting operation by the tape dispenser, there is either no dragging end preserved for the next operation. U.S. Pat. No. 4,405,068 also discloses a tape dispenser which surrounds the tape roll, wherein the cutting edge is facing the tape. Similarly, there is either no dragging end preserved for the next operation, after performing the cutting operation by the tape dispenser. The tape dispenser disclosed in U.S. Pat. No. 5,634,580 is not surrounding but is clipped on the tape roll which is provided with the tooth-like members to abut the tape roll. The patent is also installed with a window-like opening, which can allow the tape to pass therein for dragging. However, during dragging, the tape dispenser is hard to move freely on the tape roll due to the resistance of the tooth-like members; that is, the tape dispenser cannot be smoothly dragged by the peeled-off tape, and can be even separated from the tape roll. Moreover, although the tape is lifted up a little for facilitating the next dragging after performing the cutting operation, the height to be lifted is very limited, such that it will not be easy to put a finger into the clearance between the tape and the tape dispenser. U.S. Pat. No. 2,734,575 discloses a simple tape dispenser, wherein the peeled-off tape cannot drag the tape dispenser to move with it, and there is no dragging end preserved for facilitating the next operation, after performing the cutting operation by the tape dispenser.

SUMMARY OF THE INVENTION

The primary object of present invention is to solve a problem that a tape dispenser will not be able to move smoothly with dragging, during an operation of the tape dispenser which is surrounding the tape.

Another object of the present invention is to solve a problem that there is no dragging end preserved for a next usage after performing a cutting operation by a tape dispenser which is surrounding the tape.

The present invention comprises a main seat, a rotation member, a dragging member, a cutting edge, a contact member and a supporting member. The main seat has a front member and two side members, and these two side members are structured with a Concave-shaped hollow space. The distance between two side members of the main seat is a little wider than the width of a tape roll. One end of the rotation member is pivotally connected to one side member of the main seat and the other end, i.e., a non-connection end, of the rotation member can move toward to the other side member of the main seat. An assembly part is located at the non-connection end of the rotation member, and a corresponding part is located on the other side member of the main seat, so that the assembly part of the rotation member can selectively connect with the corresponding part on the other side member of the main seat. These two side members of the main seat are assembled with each other through the assembly part and the corresponding part. The assembly part and the corresponding part are assembled with a latch, a magnetic force, an adhesive, or an elastic material, wherein the latching method is applied in the present embodiment.

The dragging member is mounted between the tops of the two side members of the main seat. A cutting edge is located transversally at a top of the front member of the main seat, and the cutting edge has a predetermined distance to the dragging member. The cutting edge has a plurality of sharp points. A contact member is connected to the cutting edge for preventing the tape roll dropping from the cutting edge. A supporting member with one-side dentate shape is mounted between the two side members of the main seat, and the supporting member is located below the dragging member. The dentate shaped side of the supporting member has functionality of reducing contact area with the tape roll. A clearance space is formed between the dragging member and the supporting member, and the clearance space is preserved between the dragging member and the supporting member for allowing the tape to be passed into. The design of the aforementioned Concave-shaped hollow space can be more convenient for users to use their fingers to access the free end of the tape roll. The present invention further comprises a cover to cap the cutting edge when useless.

The present invention is provided with the following advantages:

1. The main seat and the rotation member are both surrounding a tape roll, with a clearance between the tape roll. Therefore, in dragging the tape, the tape dispenser can move freely on the tape roll following a dragging direction of the tape, without interfering with the dragging of tape at all.
2. There is a sufficient space preserved at two side members of the main seat, which can enable fingers to smoothly manipulate in the space to grip and pull the tape left behind from a previous cutting.

3. After cutting the tape, a residual section of the tape will be lifted up by the cutting edge to facilitate a next dragging.
4. For an embodiment which is provided with the supporting member, after cutting the tape, a residual section of the tape will be lifted up by the cutting edge and the supporting member, which will facilitate a next dragging, in association with the space at two side members of the main seat.

DETAILED DESCRIPTION OF THE PREFERRED EMBODIMENTS

Figure 1:
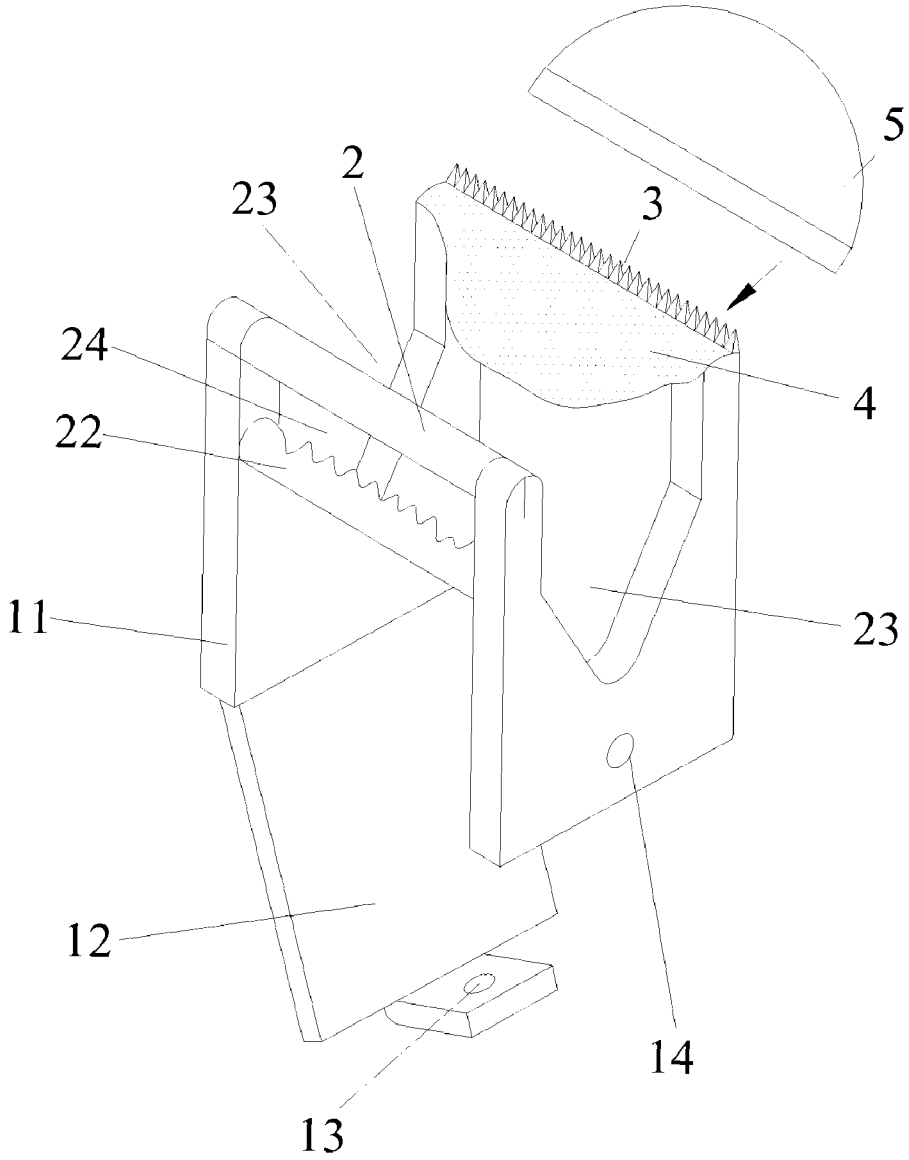
FIG. 1 shows a drawing of first embodiment of a tape dispenser for a tape roll of the present invention.

Referring to FIG. 1, a first embodiment of a tape dispenser for a tape roll of the present invention is shown. The tape dispenser comprises a main seat 11, a rotation member 12, a dragging member 2, a cutting edge 3, a contact member 4 and a supporting member 22. The main seat 11 has a front member and two side members, the two side members thereof are structured with a Concave-shaped hollow space 23. The distance between two side members of the main seat 11 is a little wider than width of a tape roll. The rotation member 12 is connected to one side member of the main seat 11 and can move toward to the other side member of the main seat 11. An assembly part 13 is located at a non-connection end of the rotation member 12, and a corresponding part 14 is located on the other side member of the main seat 11, so that the assembly part 13 of the rotation member 12 can selectively connect with the corresponding part 14 on the other side member of the main seat 11. The two side members of the main seat 11 are assembled with each other through the assembly part 13 and the corresponding part 14. The assembly part 13 and the corresponding part 14 are assembled with a latch, a magnetic force, an adhesive, or an elastic material, wherein the latching method is applied in the present embodiment.

The dragging member 2 is mounted between the tops of the two side members of the main seat 11. A cutting edge 3 is located transversally at the top of the front member of the main seat 11, and the cutting edge 3 has a predetermined distance to the dragging member 2. The cutting edge 3 has a plurality of sharp points. A contact member 4 is connected to the cutting edge 3 for preventing the tape roll dropping from the cutting edge 3. A supporting member 22 with one-side dentate shape is mounted between the two side members of the main seat 11, and the supporting member 22 is located in a distance below the dragging member 2. The dentate shape of the supporting member 22 has a functionality of reducing contact area with the tape roll. A clearance space 24 is formed between the dragging member 2 and the supporting member 22, and the clearance space 24 is preserved between the dragging member 2 and the supporting member 22 for allowing the tape to be passed into. The design of the aforementioned Concave-shaped hollow space 23 can be more convenient for users to use their fingers to access the free end of the tape roll. The present invention further comprises a cover 5 to cap the cutting edge when not in use.

Figure 2:
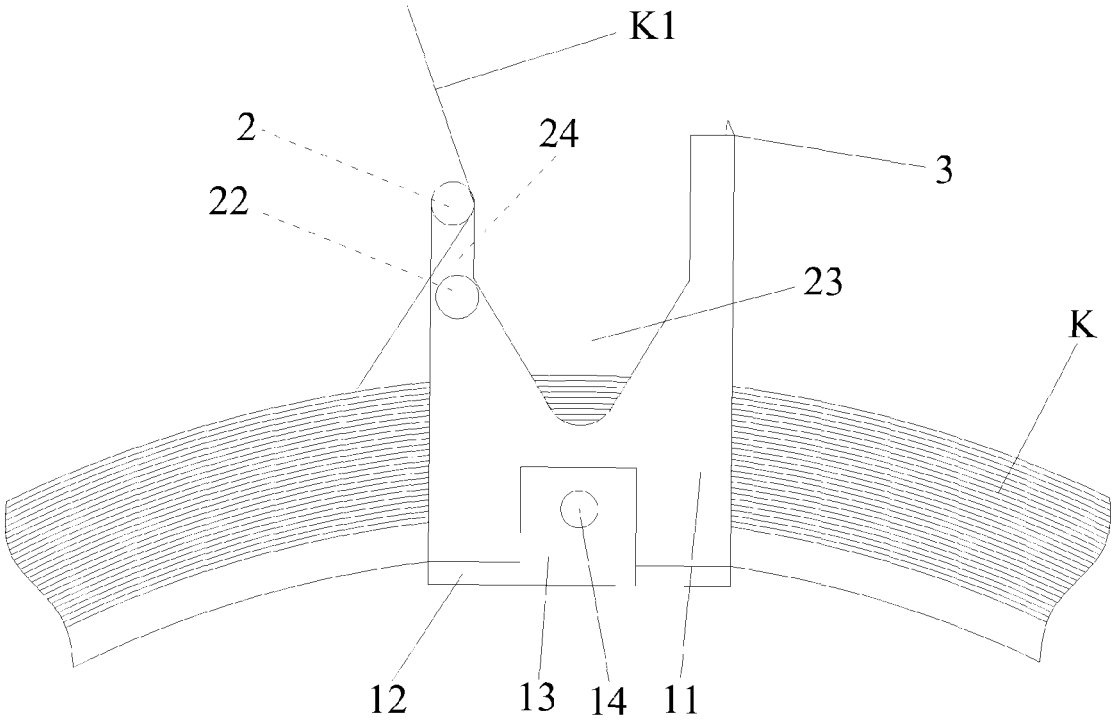
FIG. 2 shows a drawing of second embodiment of a tape dispenser for a tape roll of the present invention.

Referring to FIG. 2, a second embodiment of a tape dispenser for a tape roll of the present invention is shown. FIG. 2 shows that the rotation member 12 is opened to put a tape roll K into the main seat 11, and then the first assembly part 13 of the rotation member 12 is assembled with the corresponding part 14 of the main seat 11 for fixing, such that the main seat 11 and the rotation member 12 can be loosely sheathed on the tape roll K. After that, a free end K1 of the tape roll K is guided to pass through the clearance space 21 between the dragging member 2 and the supporting member, and reeves back to the dragging member 2. When pulling the free end K1 of the tape roll K, the main seat 11 and the rotation member 12 will be dragged to move on the tape roll K at the same time.

Figure 3:
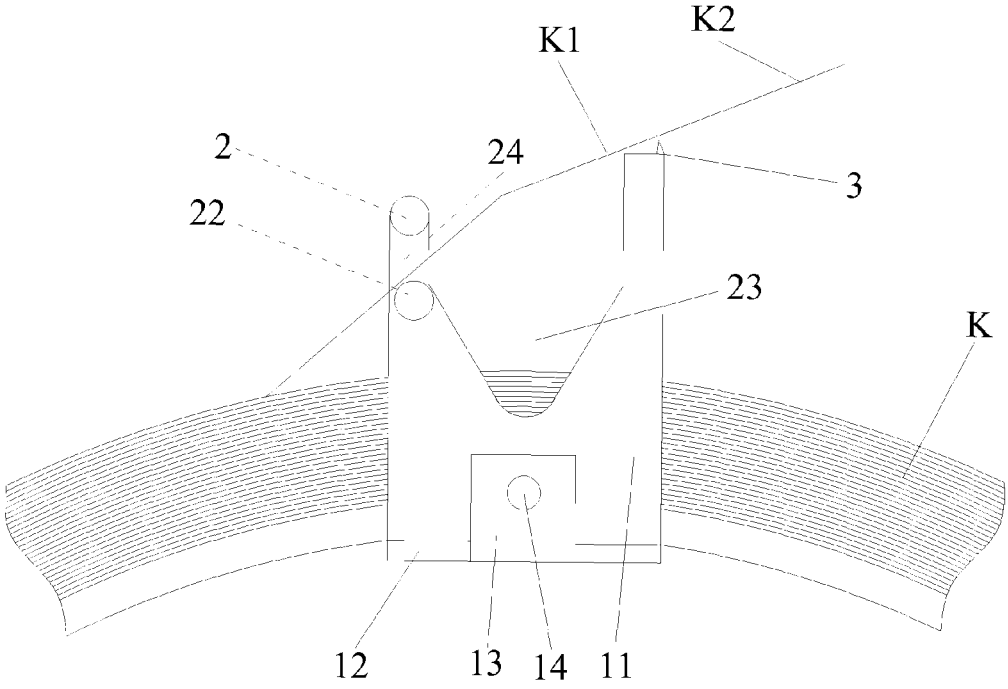
FIG. 3 shows a drawing of third embodiment of a tape dispenser for a tape roll of the present invention.

Referring to FIG. 3, a third embodiment of a tape dispenser for a tape roll of the present invention is shown. FIG. 3 shows that while the free end K1 is pulled to a predetermined length, the free end K1 is abutted on the cutting edge 2 in an opposite direction, and is pulled down. At this moment, a bottom of the rotation member 12 is supported by fingers of an operator (the status of the fingers is not shown in the drawing), to maintain a status of lifting up the free end K1, thereby cutting the free end K1 to form a cutting section K2 for use. The free end K1 left behind will be crossed over on the cutting edge 3 from the tape roll K, such that in a next operation, it can be easy to put in the fingers from the Concave-shaped hollow space 23 to easily grip the residual free end K1. After cutting off the tape, the residual free end K1 will be crossed over on the cutting edge 3 through the supporting member 22.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A tape dispenser for a tape roll, comprising:

a main seat having a front member, a rear member and two side members with a Concave-shaped hollow space which enables at least one finger to access a free end of a tape roll and pull the free end of the tape roll;

a rotation member being connected to one side member of the main seat and being able to move toward to the other side member of the main seat, so that an assembly part of the rotation member selectively connects to a corresponding part on the other side member of the main seat to enable a user to take down the tape roll by separating the assembly part and the corresponding part, the assembly part and the corresponding part are assembled with a latch, a magnetic force, an adhesive, or an elastic material;

a dragging member being mounted between tops of the two side members of the main seat and at the rear member of the main seat;

a cutting edge being located transversally at a top of the front member of the main seat, and the cutting edge having a predetermined distance to the dragging member;

a contact member being connected to the cutting edge for preventing the tape roll dropping from the cutting edge; and a supporting member being mounted between the two side members of the main seat, and the supporting member being located underneath the dragging member, the supporting member having teeth on one side of the supporting member, and the teeth extending between the two side members of the main seat wherein the contact member is separated from the supporting member that enables the user's finger to access the free end of the tape roll and pull the free end upward easily, the supporting member with the teeth is designed to reduce contact area with the tape roll for enabling the user to pull the free end of the tape roll easily, and the teeth of the supporting member is arranged in a direction perpendicular to a dragging direction of the tape roll, wherein a clearance space is formed between the dragging member and the supporting member, and the free end of the tape roll is guided to pass through the clearance space and reeves back to the dragging member for enabling the user to pull the free end of the tape roll easily such that the main seat and the rotation member are dragged to move freely on the tape roll following the dragging direction of the tape roll at the same time, wherein the free end is lifted up by the cutting edge and the supporting member to facilitate a next dragging.

2. The tape dispenser for a tape roll according to claim 1, further comprising a cover to cap the cutting edge.

* * * * *